US012135171B2

(12) United States Patent
Van Thuang et al.

(10) Patent No.: US 12,135,171 B2
(45) Date of Patent: Nov. 5, 2024

(54) SLOTTED PROFILE FOR FLUID CIRCULATION TUBE INSERTION AND ASSOCIATED HEAT EXCHANGER

(71) Applicant: LIEBHERR-AEROSPACE TOULOUSE SAS, Toulouse (FR)

(72) Inventors: Fabien Van Thuang, Toulouse (FR); Philippe Muffat-Joly, Toulouse (FR)

(73) Assignee: LIEBHERR-AEROSPACE TOULOUSE SAS, Toulouse (FR)

( * ) Notice: Subject to any disclaimer, the term of this patent is extended or adjusted under 35 U.S.C. 154(b) by 29 days.

(21) Appl. No.: 18/130,512

(22) Filed: Apr. 4, 2023

(65) Prior Publication Data

US 2023/0375284 A1 Nov. 23, 2023

(30) Foreign Application Priority Data

Apr. 4, 2022 (FR) ..... 2203063

(51) Int. Cl.
*F28F 1/20* (2006.01)

(52) U.S. Cl.
CPC ..... *F28F 1/20* (2013.01); *F28F 2255/16* (2013.01)

(58) Field of Classification Search
CPC ..... F28F 2275/10; F28F 2275/06; F28F 2275/04; F28F 2255/16; F28F 2275/14; F28F 2275/18; F28F 1/20
USPC ..... 165/47
See application file for complete search history.

(56) References Cited

U.S. PATENT DOCUMENTS 2,205,984 A * 6/1940 Kromas ..... F28F 1/20 165/172
2,342,117 A * 2/1944 Brown, Jr. ..... F28F 1/20 122/367.3
2,867,417 A * 1/1959 Nore ..... F28F 1/22 126/92 R
2,944,138 A * 7/1960 Goff ..... F24H 3/002 219/544
3,672,446 A 6/1972 Tibbetts
4,120,019 A * 10/1978 Arii ..... F28F 1/24 257/722
4,241,727 A * 12/1980 Toti ..... F28F 1/22 138/116
4,487,256 A 12/1984 Lutjens
(Continued)

*Primary Examiner* — Jon T. Schermerhorn, Jr.
(74) *Attorney, Agent, or Firm* — CRGO Global; Steven M. Greenberg

(57) ABSTRACT

The invention relates to a profiled part (12) for a heat exchanger, configured to have at least one fluid flow tube (14) passing through it, comprising, for each flow tube (14), a hollow cylinder (18) comprising an inner surface configured to receive said flow tube (14), the cylinder (18) having an inner diameter which is substantially equal to the outer diameter of said flow tube (14). The profiled part (12) is characterized in that the profiled part comprises a slit (16) extending over the whole length of the cylinder (18) and configured to permit, by application of at least one mechanical force to the profiled part, a modification in the inner diameter of the cylinder (18) in order respectively to permit the insertion of the tube into the cylinder (18) or the clamping of the tube (14) by the inner surface of the cylinder (18). The invention also relates to a heat exchanger (10) comprising such a profiled part (12) and a flow tube (14).

9 Claims, 3 Drawing Sheets

(56) References Cited

U.S. PATENT DOCUMENTS

| | | | | | |
|---|---|---|---|---|---|
| 4,624,242 | A * | 11/1986 | McCall | F24S 60/30 | 126/645 |
| 4,771,825 | A * | 9/1988 | Chen | F28F 1/20 | 165/172 |
| 5,740,772 | A * | 4/1998 | Bluma | F01M 5/002 | 210/186 |
| 5,983,995 | A * | 11/1999 | Shutou | F28D 15/0275 | 29/890.038 |
| 7,140,425 | B2 | 11/2006 | Romero-Beltran | | |
| 7,730,617 | B2 * | 6/2010 | Lin | H01L 23/427 | 29/890.032 |
| 8,499,823 | B1 * | 8/2013 | Shaw | F24D 3/16 | 165/56 |
| 8,875,395 | B2 * | 11/2014 | Wallaert | C22C 1/08 | 29/890.035 |
| 9,718,111 | B2 * | 8/2017 | Eaton | B21D 5/10 | |
| 10,066,844 | B2 * | 9/2018 | Murakami | F28F 1/20 | |
| 2013/0063958 | A1 * | 3/2013 | Wang | F28F 1/22 | 165/185 |
| 2015/0226440 | A1 * | 8/2015 | Lipinski | F24D 3/165 | 165/47 |
| 2021/0278145 | A1 * | 9/2021 | Fienup | F25D 3/08 | |
| 2022/0390189 | A1 * | 12/2022 | Graham | F28F 13/06 | |
| 2023/0332530 | A1 * | 10/2023 | Christensen | F01N 3/02 | |
| 2024/0001469 | A1 * | 1/2024 | Robert | F28F 21/084 | |

* cited by examiner

[Fig. 1]
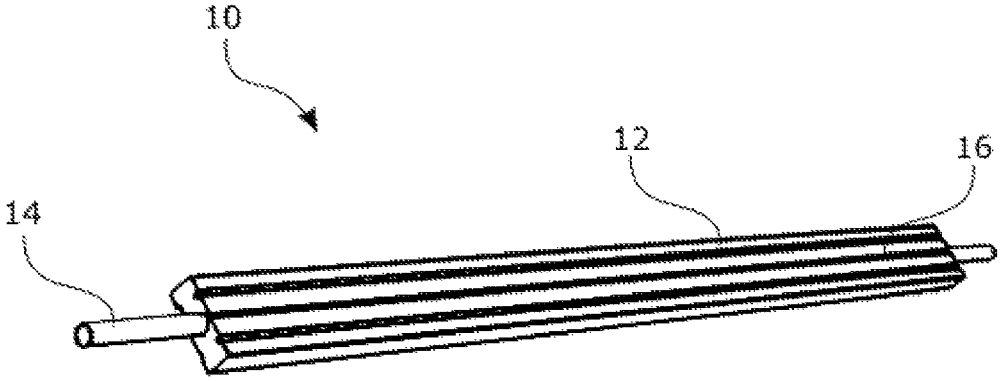
[Fig. 2]
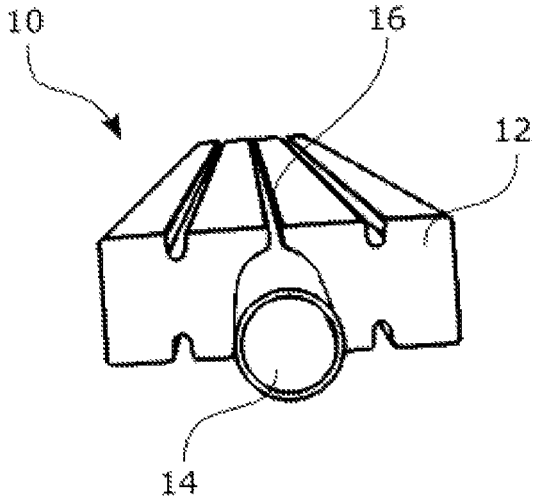
[Fig. 3]
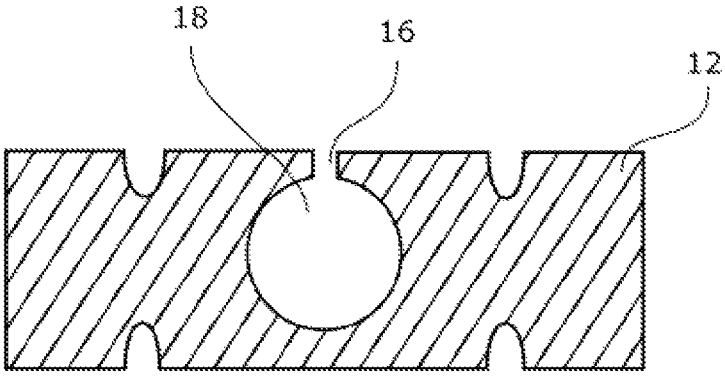

[Fig. 4]
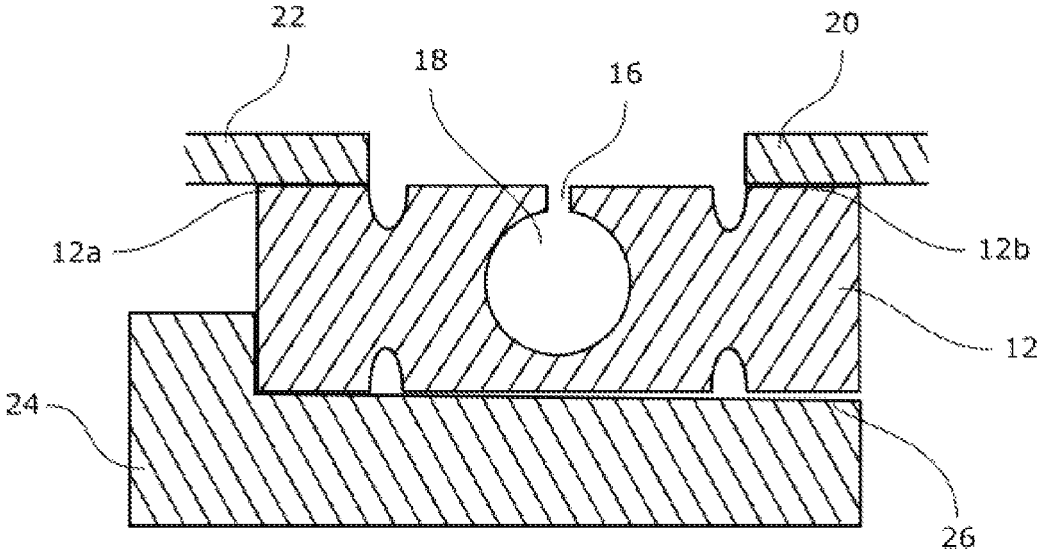
[Fig. 5]
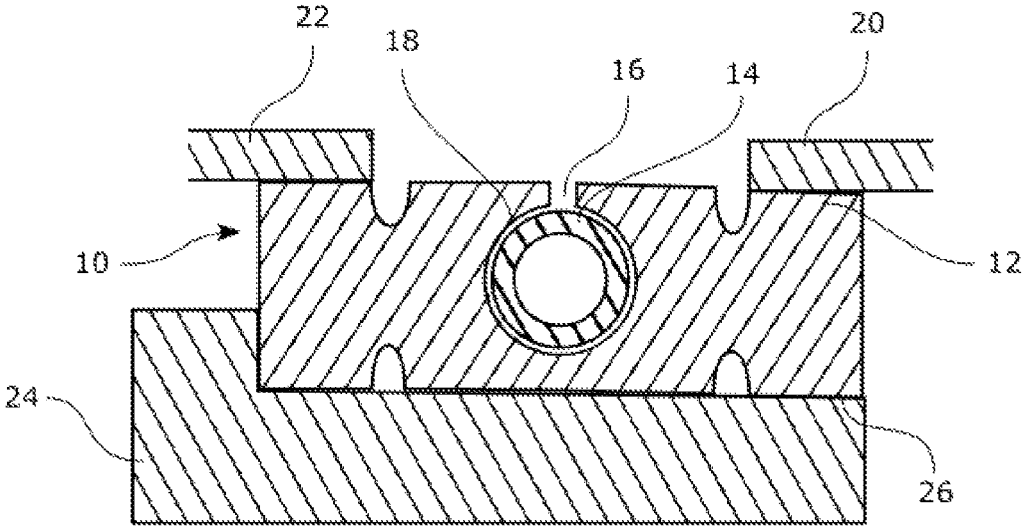

[Fig. 6]
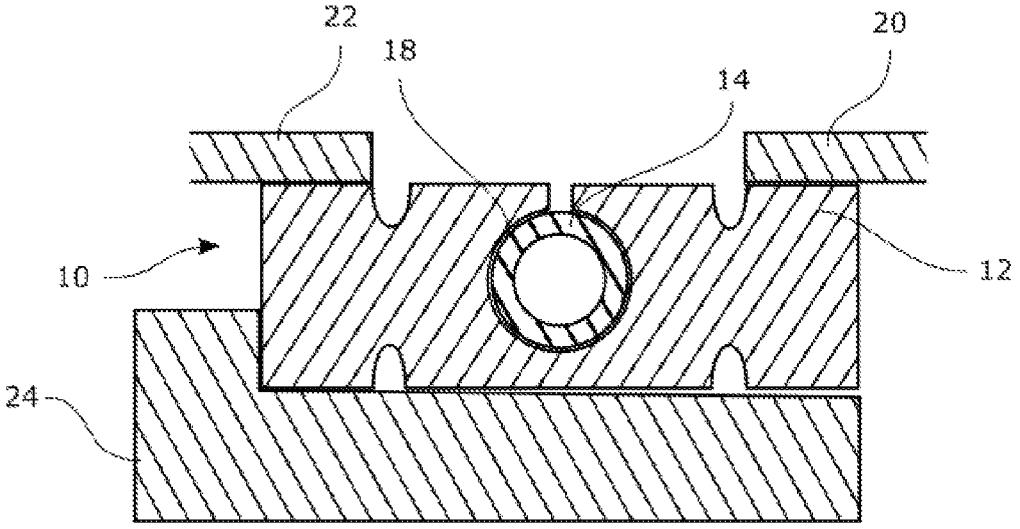
[Fig. 7]
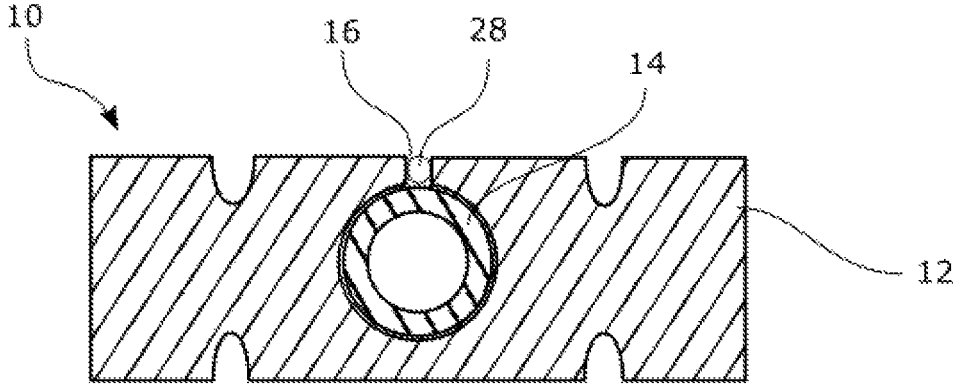

SLOTTED PROFILE FOR FLUID CIRCULATION TUBE INSERTION AND ASSOCIATED HEAT EXCHANGER

CROSS-REFERENCE TO RELATED APPLICATIONS

This application claims priority under 35 U.S.C. § 119(a) to French patent application number 2203063, filed on Apr. 4, 2022, the entire teachings of which are incorporated herein by reference.

TECHNICAL FIELD OF THE INVENTION

The invention relates to a profiled part for a heat exchanger, the associated heat exchanger and a method of manufacturing said exchanger. In particular, the invention relates to a heat exchanger able to be of the type made from stainless steel and aluminum or other combinations of two materials for use in an aeronautical or space context.

TECHNOLOGICAL BACKGROUND

The heat exchangers used in the aeronautical or space field can be in the form of an enclosure, preferably made of aluminum, surrounding a tube, preferably made of stainless steel, in which a fluid flows, in particular for a transfer of heat from the fluid towards the outside of the enclosure via the tube and the enclosure. The enclosure can be in the form e.g. of plates clasping the tube.

The exchanger is then assembled by welding or soldering the plates forming the enclosure, between which the tube is arranged.

The use of welding or soldering to assemble the exchanger involves a number of disadvantages.

The main disadvantage of assembly by welding is a difficulty of making the production of a number of parts possible on an industrial scale.

The assembly by soldering of elements of two materials of different natures generates differential expansions between the two materials owing to their different coefficients of thermal expansion, which can cause cohesion failure in the heat exchanger owing to the soldering, in particular when a number of parts are required in order to clasp the tube. This can jeopardize the mechanical behavior of the exchanger and specific solutions must be implemented in order to manage these thermal stresses during soldering.

The inventors have thus sought a solution making it possible to facilitate industrial-scale production of heat exchangers comprising a tube surrounded by an enclosure.

Aims of the Invention

The invention aims to provide a profiled part for a heat exchanger, a heat exchanger comprising this profiled part and a method of manufacturing said exchanger.

The invention aims in particular to provide, in at least one embodiment, a profiled part and an exchanger assembled in a way which is simple and can be achieved on an industrial scale.

The invention also aims to provide, in at least one embodiment of the invention, a profiled part and an exchanger which is compatible with a long tube, in particular of a length greater than 3 m.

The invention also aims to provide, in at least one embodiment of the invention, a method of manufacturing the heat exchanger which limits the internal stresses in order to avoid deformations owing to differential expansions during assembly.

DESCRIPTION OF THE INVENTION

In order to do this, the invention relates to a profiled part for a heat exchanger, configured to have at least one fluid flow tube passing through it, comprising, for each flow tube, a hollow cylinder comprising an inner surface configured to receive said flow tube, the cylinder having, in the absence of any mechanical force, a circular cross-section with an inner diameter which is substantially constant over its whole length and substantially equal to the outer diameter of said flow tube, characterized in that the profiled part comprises a slit extending over the whole length of the cylinder and configured to permit, by application of at least one mechanical force to the profiled part, an increase or decrease in the inner diameter of the cylinder in order respectively to permit the insertion of the tube into the cylinder or the clamping of the tube by the inner surface of the cylinder.

A profiled part in accordance with the invention thus makes it possible to receive a tube by threading it in using the presence of the slit for the adjustment of the inner diameter of the profiled part. The inner diameter of the cylinder of the profiled part can be increased in order to permit the tube to be threaded in, or decreased in order to clamp the tube when it is in its final assembly position. The insertion by threading-in consists of aligning an end of the tube with one of the openings formed at each end of the profiled part, in particular at one of the bases of the hollow cylinder of the profiled part, and of inserting by sliding the length of the tube via this opening until the tube is fully inserted into the profiled part.

The profiled part in accordance with the invention is particularly suited for receiving a long tube, e.g. of a length greater than 3 m, the slit making it possible to facilitate assembly even when the inner diameter of the cylinder of the profiled part and the outer diameter of the tube are substantially equal. Without the presence of the slit, the threading-in becomes difficult, even impossible, above a certain length, in particular for a human operator. The profiled part can also receive tubes shorter than, or equal to, 3 m.

According to a first variant of the invention, a weld joint can be applied along the slit at the end of assembly. This weld joint can improve the clamping effect and even the heat exchange between the tube and the profiled part, depending on the material used.

According to a second variant of the invention, soldering can be implemented by prior application of a metallized layer to the tube before insertion into the profiled part, then soldering of the assembled exchanger. The metallized layer is preferably applied by cold spraying, and the final soldering makes it possible to form the solder joint between the tube and the hollow cylinder of the profiled part. The soldering does not cause cohesion failure of the exchanger since clamping is made possible by the profiled part. In this case, the soldering makes it possible to improve the heat exchange between the tube and the profiled part.

The profiled part thus forms the enclosure of the tube in order to form the heat exchanger. In contrast to the prior art method using soldering described above, with a number of parts clasping the tube, the assembly of such a profiled part with the tube in order to create the heat exchange does not necessitate the application of a high level of heat, which would cause cohesion failure between parts forming the exchanger owing to the soldering.

The profiled part is e.g. manufactured by extrusion, and is preferably made of aluminum. The slit is preferably present during manufacture of the profiled part by extrusion but can also be created by machining following manufacture of the profiled part.

In the absence of mechanical force, the inner diameter of the cylinder of the profiled part is substantially equal to the outer diameter of the tube it is intended to receive, i.e. of the order of more or less 5% of the outer diameter of the tube it is intended to receive, in particular can be:

- slightly greater than the outer diameter of the tube, which simplifies the threading-in of the tube, in particular for long tubes,
- equal to the outer diameter of the tube, the slit making it possible to increase the inner diameter for the threading-in of the tube, or
- slightly less than the outer diameter of the tube, the slit making it possible to increase the inner diameter for the threading-in of the tube, and the relaxing of the mechanical forces permitting clamping of the tube.

The difference between the outer diameter of the tube and the inner diameter of the cylinder is preferably less than one millimeter, preferably less than some tenths of a millimeter in particular if the tube to be inserted is long (e.g. of a length greater than three meters), preferably even less than some hundredths of a millimeter if the tube to be inserted is short (e.g. of a length less than three meters). In the same way, the increase or the decrease in the inner diameter of the hollow cylinder during application of the mechanical force to the profiled part is minimal, preferably less than one millimeter, preferably less than some tenths of a millimeter in particular if the inserted tube is long (e.g. of a length greater than three meters), preferably even less than some hundredths of a millimeter if the inserted tube is short. The slit thus cannot be opened sufficiently to permit forcing of the placement of the tube by passing through the slit, in particular when the profiled part is made of metal. However, the minimal increase in the inner diameter of the hollow cylinder is sufficient to permit insertion by threading-in by causing the tube to slide via an opening in the hollow cylinder, as stated above.

Advantageously and in accordance with the invention, the profiled part comprises at least two bearing surfaces on either side of the hollow cylinder, which are configured to receive at least one tool permitting application of said at least one mechanical force to the profiled part.

According to this aspect of the invention, the bearing surfaces are adapted to a tool specifically dedicated to the application of the mechanical force or forces applied to the profiled part. The tool may act on the whole length of the profiled part, in particular when the tube to be threaded-in is long.

The invention also relates to a heat exchanger characterized in that it comprises a profiled part in accordance with the invention and at least one fluid flow tube, and configured to permit an exchange of heat between the fluid flowing in the tube and the profiled part.

An exchanger in accordance with the invention thus comprises a profiled part in accordance with the invention, can be assembled without risk of cohesion failure owing to soldering, and can be manufactured for long tubes, in particular longer than 3 m. The contact between the profiled part and the tube is maximized owing to the relaxing of the mechanical forces on the profiled part at the end of the threading-in of the tube. The exchanger obtained is simpler to manufacture and is stronger. Surface treatment of the tube or of the profiled part is possible, in particular prior to assembly of the exchanger or after assembly, e.g. an SAO (sulfuric anodic oxidation) treatment, TCS PACS, physical vapor deposition. PVD, treatment and chemical vapor deposition, CVD, treatment.

Advantageously, the invention relates in particular to a heat exchanger comprising a profiled part and at least one fluid flow tube and configured to make possible an exchange of heat between the fluid flowing in the tube and the profiled part, the profiled part being configured to have each fluid flow tube passing through it, comprising, for each flow tube, a hollow cylinder comprising an inner surface configured to receive said flow tube, the cylinder having, in the absence of any mechanical force, a circular cross-section with an inner diameter which is substantially constant over its whole length and substantially equal to the outer diameter of said flow tube, characterized in that the profiled part comprises a slit extending over the whole length of the cylinder and configured to permit, by application of at least one mechanical force to the profiled part, an increase or decrease in the inner diameter of the cylinder in order respectively to permit the insertion of the tube into the cylinder or the clamping of the tube by the inner surface of the cylinder, and in that the tube is previously covered with a metallized layer before being inserted into the cylinder, said metallized layer being configured for soldering of the tube and of the cylinder when the tube is inserted in the cylinder.

The invention also relates to a method of manufacturing a heat exchanger in accordance with the invention by insertion of at least one fluid flow tube into a profiled part in accordance with the invention, characterized in that it comprises the following steps for each tube:

- a step of applying a mechanical force to the profiled part in order to enlarge the inner diameter of the hollow cylinder of the profiled part,
- a step of inserting the tube into the profiled part,
- a step of relaxing the mechanical force on the profiled part in order to reduce the inner diameter of the hollow cylinder of the profiled part and to clamp the inner surface of the hollow cylinder with the outer surface of the tube.

A method in accordance with the invention can easily be made possible on an industrial scale by the use of a tool suitable for the application of the mechanical force or forces, and preferably the use of a tool for threading the tube into the profiled part. The method is also simpler, less expensive and more reliable.

The tool is in particular adapted to permit the application of the mechanical force over a large part, or even all, of the length of the profiled part in order to facilitate the insertion of the tube by threading it in.

Advantageously and according to a first variant of the invention, the method of manufacture comprises a final step of welding the tube and the profiled part over the length of the slit in the profiled part.

Advantageously and according to a second variant of the invention, the method of manufacture comprises a preliminary step of application of a metallized layer to the tube, and a final step of soldering the heat exchanger so that the metallized layer forms a solder joint between the tube and the hollow cylinder of the profiled part.

The invention also relates to a profiled part, a heat exchanger and a method of manufacture which are characterized in combination by all or some of the features mentioned above or below.

LIST OF FIGURES

Other aims, features and advantages of the invention will become apparent upon reading the following description given solely in a non-limiting way and which makes reference to the attached figures in which:

FIG. 1 is a schematic perspective view of a heat exchanger in accordance with one embodiment of the invention;

FIG. 2 is a schematic perspective view of a static mixer of a mixing device in accordance with one embodiment of the invention;

FIG. 3 is a schematic cross-sectional view of a profiled part in accordance with one embodiment of the invention;

FIG. 4 is a schematic cross-sectional view of a profiled part in accordance with one embodiment of the invention installed in a tool;

FIG. 5 is a schematic cross-sectional view of a heat exchanger in accordance with one embodiment of the invention comprising a profiled part installed in a tool, when a tube is being threaded into the profiled part;

FIG. 6 is a schematic cross-sectional view of a heat exchanger in accordance with one embodiment of the invention comprising a profiled part installed in a tool, at the end of the threading of the tube into the profiled part;

FIG. 7 is a schematic cross-sectional view of a heat exchanger in accordance with one embodiment of the invention.

DETAILED DESCRIPTION OF AN EMBODIMENT OF THE INVENTION

In the figures, for the sake of illustration and clarity, scales and proportions have not been strictly respected.

Furthermore, identical, similar or analogous elements are designated by the same reference signs in all the figures.

FIG. 1 and FIG. 2 show a schematic perspective view of a heat exchanger 10 in accordance with one embodiment of the invention. The heat exchanger 10 comprises a profiled part 12, preferably made of aluminum, through which passes a tube 14, preferably made of stainless steel, making possible the flow of a fluid, for an exchange of heat between the fluid and the profiled part and more generally between the fluid and the environment outside the profiled part.

The profiled part 12 comprises a slit 16 which makes it possible to facilitate the threading-in of the tube 14 during manufacture of the heat exchanger 10.

FIG. 3 shows a schematic cross-sectional view of a profiled part 12 according to one embodiment of the invention, such as used e.g. in the heat exchanger described with reference to FIGS. 1 and 2.

The profiled part 12 comprises a hollow cylinder 18 making it possible to receive the tube in order to form the heat exchanger.

FIG. 4, FIG. 5 and FIG. 6 show schematic cross-sectional views of different steps of assembling a heat exchanger 10 by means of a tool. In FIG. 4, a single profiled part 12 is installed in the tool in order to be able to thread in the tube in order to form the heat exchanger. The tool comprises several schematically illustrated parts, in particular a movable bearing portion 20, a fixed bearing portion 22 and a support portion 24. The fixed bearing portion 22 holds the profiled part 12 by means of a first bearing surface 12*a* of the profiled part, while the movable bearing portion 20 can be moved in order to exert a mechanical force on the profiled part 12 via a second bearing surface 12*b* of the profiled part. The support portion 24 comprises an inclined surface 26 permitting the movement of a portion of the profiled part 12 under the effect of this mechanical force. In FIG. 4, no mechanical force is applied to the profiled part 12 which is in a resting position, held in place.

The tool and its various portions extend over a large part, or even all, of the length of the profiled part in order to permit the mechanical force applied to the profiled part to be rendered uniform.

FIG. 5 shows a step of application of a mechanical force to the profiled part and a step of insertion of the tube 14 into the hollow cylinder 18 of the profiled part 12. The mechanical force is supplied by a clamping action by the movable bearing portion 20 applying a force to the profiled part 12 in the direction of the surface 22 of the support portion 24. Under the effect of this force and by reason of the presence of the slit 16, the inner diameter of the hollow cylinder 18 increases, which makes it possible to facilitate the insertion (or threading) of the tube into the profiled part 12 in order to form the exchanger.

When the tube is threaded in the profiled part at its intended location, the bearing portion 20 relaxes its mechanical force and the profiled part resumes its resting position, as shown in FIG. 6. The inner diameter of the hollow cylinder 18 decreases and clamps the tube 14 via contact between the inner surface of the hollow cylinder 18 and the outer surface of the tube 14.

FIG. 7 schematically illustrates a cross-sectional view of the heat exchanger 10 thus assembled. A weld joint 28 can be produced at the slit 16. The weld joint makes it possible to improve the heat exchange between the tube 14 and the profiled part 12.

The invention is not limited to the embodiments described. In particular, the profiled part can be of different shapes. Furthermore, the inner diameter of the hollow cylinder of the profiled part at rest can be greater than, equal to or less than the outer diameter of the tube, depending on the length of the tube and the difficulty of insertion thereof.

Furthermore, the method of manufacturing the exchanger can provide a preliminary step of application of a metallized layer to the tube before the insertion of the tube into the profiled part and, following the insertion of the tube into the profiled part, a final step of soldering the heat exchanger so that the metallized layer forms a solder joint between the tube and the hollow cylinder of the profiled part. This solder joint makes it possible to improve the heat exchange between the tube and the profiled part without cohesion failure of the exchanger since clamping is made possible directly by the profiled part.

The invention claimed is:

1. A profiled part for a heat exchanger, configured to have at least one fluid flow tube passing therethrough, comprising, for each flow tube, a hollow cylinder comprising an inner surface configured to receive said flow tube, the cylinder having, in the absence of any mechanical force, a circular cross-section with an inner diameter which is substantially constant over its whole length and substantially equal to the outer diameter of said flow tube, wherein the profiled part comprises a slit extending over the whole length of the cylinder and configured to permit, by application of at least one mechanical force to the profiled part, an increase or decrease in the inner diameter of the cylinder in order respectively to permit the insertion of the tube into the cylinder or the clamping of the tube by the inner surface of the cylinder.

2. The profiled part as claimed in claim 1, further comprising at least two bearing surfaces on either side of the hollow cylinder, which are configured to receive at least one tool permitting application of said at least one mechanical force to the profiled part.

3. The profiled part as claimed in claim 1, wherein the part is manufactured from aluminum.

4. The profiled part as claimed in claim 1, wherein the part is manufactured by extrusion.

5. A heat exchanger comprising:

a profiled part configured to have at least one fluid flow tube passing therethrough, comprising, for each flow tube, a hollow cylinder comprising an inner surface configured to receive said flow tube, the cylinder having, in the absence of any mechanical force, a circular cross-section with an inner diameter which is substantially constant over its whole length and substantially equal to the outer diameter of said flow tube, wherein the profiled part comprises a slit extending over the whole length of the cylinder and configured to permit, by application of at least one mechanical force to the profiled part, an increase or decrease in the inner diameter of the cylinder in order respectively to permit the insertion of the tube into the cylinder or the clamping of the tube by the inner surface of the cylinder; and at least one fluid flow tube (14), and configured to permit an exchange of heat between the fluid flowing in the tube (14) and the profiled part (12).

6. The heat exchanger as claimed in claim 5, wherein the tube (14) is made from stainless steel.

7. A method of manufacturing a heat exchanger, by insertion of at least one fluid flow tube into a profiled part configured to have at least one fluid flow tube passing therethrough, comprising, for each flow tube, a hollow cylinder comprising an inner surface configured to receive said flow tube, the cylinder having, in the absence of any mechanical force, a circular cross-section with an inner diameter which is substantially constant over its whole length and substantially equal to the outer diameter of said flow tube, wherein the profiled part comprises a slit extending over the whole length of the cylinder and configured to permit, by application of at least one mechanical force to the profiled part, an increase or decrease in the inner diameter of the cylinder in order respectively to permit the insertion of the tube into the cylinder or the clamping of the tube by the inner surface of the cylinder, the method comprising the following steps for each tube:

a step of applying a mechanical force to the profiled part in order to enlarge the inner diameter of the hollow cylinder of the profiled part, a step of inserting the tube into the profiled part, a step of relaxing the mechanical force on the profiled part in order to reduce the inner diameter of the hollow cylinder of the profiled part and to clamp the inner surface of the hollow cylinder with an outer surface of the tube.

8. The method of manufacture as claimed in claim 7, further comprising a final step of welding the tube and the profiled part over the length of the slit in the profiled part.

9. The method of manufacture as claimed in claim 7, further comprising a preliminary step of application of a metallized layer to the tube, and a final step of soldering the heat exchanger so that the metallized layer forms a solder joint between the tube and the hollow cylinder of the profiled part.

* * * * *